US010872564B2

(12) United States Patent
Choi et al.

(10) Patent No.: US 10,872,564 B2
(45) Date of Patent: Dec. 22, 2020

(54) DATA DRIVER INTEGRATED CIRCUIT, DISPLAY DEVICE COMPRISING THE SAME, AND METHOD OF DRIVING THE SAME

(71) Applicant: LG DISPLAY CO., LTD., Seoul (KR)

(72) Inventors: Jisu Choi, Paju-si (KR); Myunggi Lim, Paju-si (KR); Taeyoung Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/597,072

(22) Filed: Oct. 9, 2019

(65) Prior Publication Data

US 2020/0118485 A1 Apr. 16, 2020

(30) Foreign Application Priority Data

Oct. 10, 2018 (KR) ..... 10-2018-0120722

(51) Int. Cl.
*G09G 3/325* (2016.01)

(52) U.S. Cl.
CPC ..... *G09G 3/325* (2013.01); *G09G 2300/0828* (2013.01); *G09G 2300/0876* (2013.01); *G09G 2310/0291* (2013.01); *G09G 2310/0294* (2013.01)

(58) Field of Classification Search
CPC ... G09G 2300/0828; G09G 2300/0876; G09G 2310/0291; G09G 2310/0294; G09G 3/325
USPC ..... 345/76
See application file for complete search history.

(56) References Cited

U.S. PATENT DOCUMENTS 9,223,334 B2 12/2015 Noda
2005/0068076 A1* 3/2005 Iroaga ..... G05F 3/262 327/158
2013/0088157 A1* 4/2013 Noda ..... G05F 3/24 315/173

FOREIGN PATENT DOCUMENTS

KR 10-2013-0028943 A 3/2013

* cited by examiner

*Primary Examiner* — Mark Edwards
(74) *Attorney, Agent, or Firm* — Birch, Stewart, Kolasch & Birch LLP

(57) ABSTRACT

A data driver IC can include an analog-to-digital converter; a sensing part that, in a sensing mode for sensing the driving characteristics of pixels, samples a signal outputted from the pixels in response to a data voltage for sensing, and, in a calibration mode for sensing the output characteristics of the analog-to-digital converter, samples a calibration current and outputs the same to the analog-to-digital converter; and a current generator that generates N calibration currents by dividing an external input source current into N parts, where N is a natural number.

15 Claims, 10 Drawing Sheets

| | Sensing part output | Timing controller |
|---|---|---|
| 1 | SEN_DATA#1 | Average(1:N) |
| 2 | SEN_DATA#2 | |
| ... | ... | |
| N | SEN_DATA#N | |

DATA DRIVER INTEGRATED CIRCUIT, DISPLAY DEVICE COMPRISING THE SAME, AND METHOD OF DRIVING THE SAME

CROSS-REFERENCE TO RELATED APPLICATION

This application claims the priority benefit of Korean Patent Application No. 10-2018-0120722 filed on Oct. 10, 2018 in the Republic of Korea, which is incorporated herein by reference for all purposes as if fully set forth herein.

BACKGROUND OF THE INVENTION

Field of the Invention

The present invention relates to a data driver integrated circuit (IC), a display device comprising the same, and a method of driving the same.

Related Art

An active-matrix organic light-emitting display comprises self-luminous organic light-emitting diodes (hereinafter, "OLEDs"), and has the advantages of fast response time, high luminous efficiency, high luminance, and wide viewing angle.

In an organic light-emitting display, pixels each comprising an organic light emitting diode are arranged in a matrix, and the luminance of the pixels is adjusted based on the grayscale values of video data. Each individual pixel comprises a driving TFT (thin-film transistor) that controls the drive current flowing through the OLED in response to their gate-source voltage Vgs. The amount of light emitted by the OLED is proportional to the drive current, and the brightness of display is adjusted by the amount of light emission.

However, the organic light-emitting display may deteriorate over time, including an increase in the threshold voltage Vth of the OLEDs and a decrease in luminous efficiency. The degree of deterioration in the OLEDs may differ for each pixel. Variation in the degree of deterioration between individual pixels can cause variation in brightness and degradation in picture quality.

To address this, there is a known technology to sense the driving characteristics of each pixel and compensate for input video data depending on the degree of deterioration. In order to compensate for current characteristics, which are pixels' driving characteristics, a sensor for sensing the driving characteristics of pixels and an analog-to-digital converter (hereinafter, "ADC") for converting analog sensing data inputted from the sensor into digital sensing data are required.

However, any variation in the characteristics of the ADC can cause distortion in digital sensing data, and this can result in a failure to properly compensate for the brightness variation in the pixels.

SUMMARY OF THE INVENTION

To address the above-identified limitations and other disadvantages associated with the related art, the present invention is directed to providing a data driver IC capable of improving the performance for compensating for the driving characteristics of pixels by compensating for variation in the characteristics of an ADC, a display device comprising the same, and a method of driving the same.

An exemplary embodiment of the present invention provides a data driver IC which comprises an analog-to-digital converter; a sensing part that, in a sensing mode for sensing the driving characteristics of pixels, samples a signal outputted from the pixels in response to a data voltage for sensing, and, in a calibration mode for sensing the output characteristics of the analog-to-digital converter, samples a calibration current and outputs the same to the analog-to-digital converter; and a current generator that generates N calibration currents by dividing an external input source current into N parts (N is a natural number).

The current generator can comprise N current distributors that store the source current as N calibration currents; N sampling switches that control the supply of the source current inputted to the N current distributors; and N sensing switches that control the calibration currents to output the same to the sensing part.

In the current generator, when all of the N sampling switches are turned on and all of the N sensing switches are turned off, the source current can be stored in the N current distributors, and, when all of the N sampling switches are turned off and the N sensing switches are selectively turned on, the calibration currents can be outputted to the sensing part.

The current distributors can comprise N transistors of the same channel size.

The current distributors can comprise a sampling capacitor that stores the gate-source voltages of the transistors.

The transistors included in the current generator can be N-type transistors.

The sensing part can comprise an AMP (amplifier) having a non-inverting input terminal connected to a reference voltage, an inverting input terminal for receiving the calibration currents, and an output terminal; a reset switch and a feedback capacitor connected in parallel between the inverting input terminal and the output terminal; and a sample and hold part that samples the output of the AMP and outputs the same to the analog-to-digital converter.

The data driver IC can further comprise a voltage supply part that supplies a video data voltage to the pixels in a display mode and supplies a data voltage for sensing to the pixels in the sensing mode.

Another exemplary embodiment of the present invention provides a display device comprising a display panel with a plurality of pixels; and the above-described data driver IC connected to the display panel.

The display device can further comprise a timing controller that corrects input video data to be written to the pixels, based on first characteristic data produced by sampling a signal outputted from the pixels and second characteristic data produced by sampling a calibration current.

The timing controller can correct the input video data by receiving an N number of second characteristic data corresponding to N calibration currents and taking the average of the N number of second characteristic data.

Another exemplary embodiment of the present invention provides a display device comprising a display panel with a plurality of pixels connected to sensing lines; a current source that supplies an electrical current; a data driver IC having a sensing part that, in a sensing mode for sensing the driving characteristics of the pixels, samples a signal outputted from the pixels in response to a data voltage for sensing to output first characteristic data to an analog-to-digital converter, and, in a calibration mode for sensing the output characteristics of the analog-to-digital converter, samples a calibration current to output second characteristic data to the analog-to-digital converter; and a timing controller that corrects input video data to be written to the pixels based on the first characteristic data and the second characteristic data, wherein the data driver IC generates N calibration currents by dividing the current supplied from the current source into N parts (N is a natural number).

The data driver IC can comprise a current generator comprising N current distributors that store the current supplied from the current source as N calibration currents, N sampling switches that control the supply of the source current inputted to the N current distributors, and N sensing switches that control the calibration currents to output the same to the sensing part, wherein the timing controller corrects the input video data by receiving an N number of second characteristic data corresponding to N calibration currents and taking the average of the N number of second characteristic data.

Another exemplary embodiment of the present invention provides a method of driving a display device, which comprises generating N calibration currents by a current generator inside a data driver IC by dividing an external input source current into N parts (N is a natural number); sampling the N calibration currents to produce an N number of digital data by a sensing part inside the data driver IC; receiving the N number of digital data and taking the average thereof by a timing controller; storing the calculated average value as second characteristic data representing the output characteristics of the analog-to-digital converter of the sensing part; and correcting video data based on the second characteristic data by the timing controller.

The method can further comprise sampling a signal outputted from pixels in response to a data voltage for sensing to produce digital data by the sensing part inside the data driver IC; and storing the digital data produced by sampling a signal outputted from the pixels as first characteristic data representing the driving characteristics of the pixels, wherein the correcting of video data comprises correcting input video data to be written to the pixels based on the first characteristic data and the second characteristic data.

With this configuration, the embodiments of the present invention can improve the performance for compensating for the driving characteristics of pixels by compensating for variation in the characteristics of the ADC included in the data driver IC.

The embodiments of the present invention can reduce current errors and noise and decrease sensing time by forming a current generator inside the data driver IC and supplying calibration currents for sensing the output characteristics of the ADC, rather than by the conventional approach of supplying an electrical current from outside the data driver IC.

Furthermore, while the conventional approach has the problems like increased PCB area and increased production costs because a large-sized circuit including a plurality of resistors is required in order to generate low calibration currents outside the data driver IC, the embodiments of the present invention allow for a decrease in the layout area of the PCB required for low calibration current generation and a reduction in production costs by generating calibration currents inside the data driver IC.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DESCRIPTION OF THE EMBODIMENTS

Figure 1:
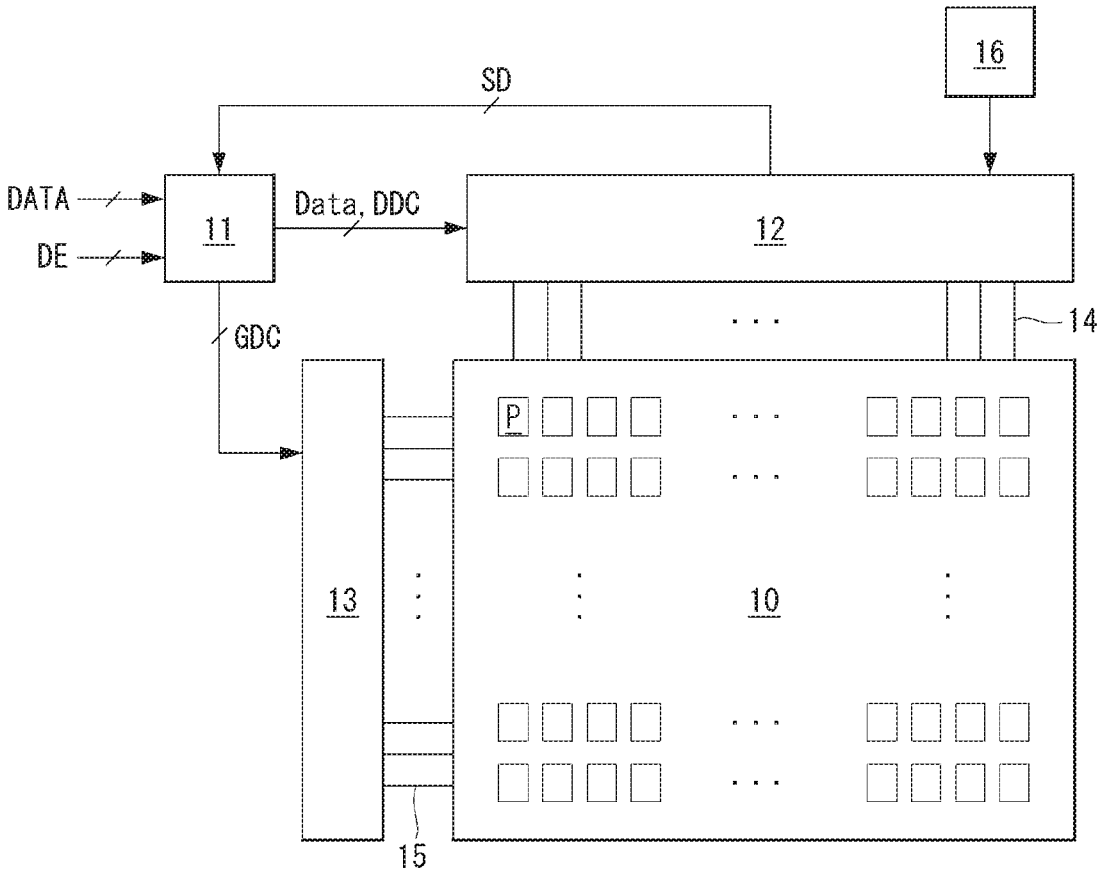
FIG. 1 is a schematic block diagram of a display device according to an exemplary embodiment of the present invention.

Advantages and features of the present disclosure and methods of accomplishing the same can be understood more readily by reference to the following detailed description of preferred embodiments and the accompanying drawings. The present invention can, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims.

The shapes, sizes, proportions, angles, numbers, etc. shown in the figures to describe the exemplary embodiments of the present invention are merely examples and not limited to those shown in the figures. Like reference numerals denote like elements throughout the specification. When the terms 'comprise', 'have', 'consist of' and the like are used, other parts can be added as long as the term 'only' is not used. The singular forms can be interpreted as the plural forms unless explicitly stated.

The elements can be interpreted to include an error margin even if not explicitly stated.

When the position relation between two parts is described using the terms 'on', 'over', 'under', 'next to' and the like, one or more parts can be positioned between the two parts as long as the term 'immediately' or 'directly' is not used.

It will be understood that, although the terms first, second, etc., can be used to describe various elements, these elements should not be limited by these terms. These terms are only used to distinguish one element from another element. Thus, a first element discussed below could be termed a second element without departing from the technical idea of the present invention.

Like reference numerals denote like elements throughout the specification.

Hereinafter, an exemplary embodiment of the present invention will be described with reference to the accompanying drawings. In describing the present invention, detailed descriptions of related well-known technologies will be omitted to avoid unnecessary obscuring the present invention.

A display device according to one or more embodiments of the present invention can be implemented as a navigation system, a video player, a personal computer (PC), a wearable (watch or glasses), a mobile phone (smartphone), etc. A display panel of the display device can be, but is not limited to, a liquid-crystal display panel, an organic light-emitting display panel, an electrophoretic display panel, or a plasma display panel. In the description below, an organic electroluminescence display will be given as an example for convenience of explanation.

FIG. 1 is a schematic block diagram of a display device according to an exemplary embodiment of the present invention. All the components of the display device according to the embodiments of the present invention are operatively coupled and configured.

Referring to FIG. 1, the display device comprises a display panel 10, a scan driver 13, a data driver IC 12, a timing controller 11, and a current source 16 for supplying an electrical current to the data driver IC 12.

A plurality of data lines 14 and a plurality of scan lines 15 intersect on the display panel 10, and pixels P are arranged in a matrix at the intersections.

The timing controller 16 is supplied with a data signal DATA in addition to a data enable signal DE or a driving signal including a vertical synchronization signal, a horizontal synchronization signal, and a clock signal. Based on the driving signal, the timing controller 11 outputs a gate timing control signal GDC for controlling the operation timing of the scan driver 13, and a data timing control signal DDC for controlling the operation timing of the data driver IC 12.

The scan driver 13 outputs a scan signal in response to the gate timing control signal GDC supplied from the timing controller 11. The scan driver 13 outputs a scan signal of scan-high voltage and scan-low voltage through the scan lines 15. The scan driver 13 can be formed in the form of an integrated circuit (IC) or in a gate-in-panel manner on the display panel 10.

The data driver IC 12 converts digital video data DATA into the form of voltage signal based on gamma reference voltage, in response to the data timing control signal DDC supplied from the timing controller 11. Also, the data driver IC 12 senses first characteristic data representing the driving characteristics of the pixels and second characteristic data representing the characteristics of a sensing part 24 for sensing the first characteristic data, and sends sensing data SD as feedback to the timing controller 11.

The current source 16 supplies an electrical current for the sensing operation of the data driver IC 12.

The timing controller 11 can correct video data Data to be written to the pixels P based on the first characteristic data and second characteristic data fed back from the data driver IC 12.

Figure 2:
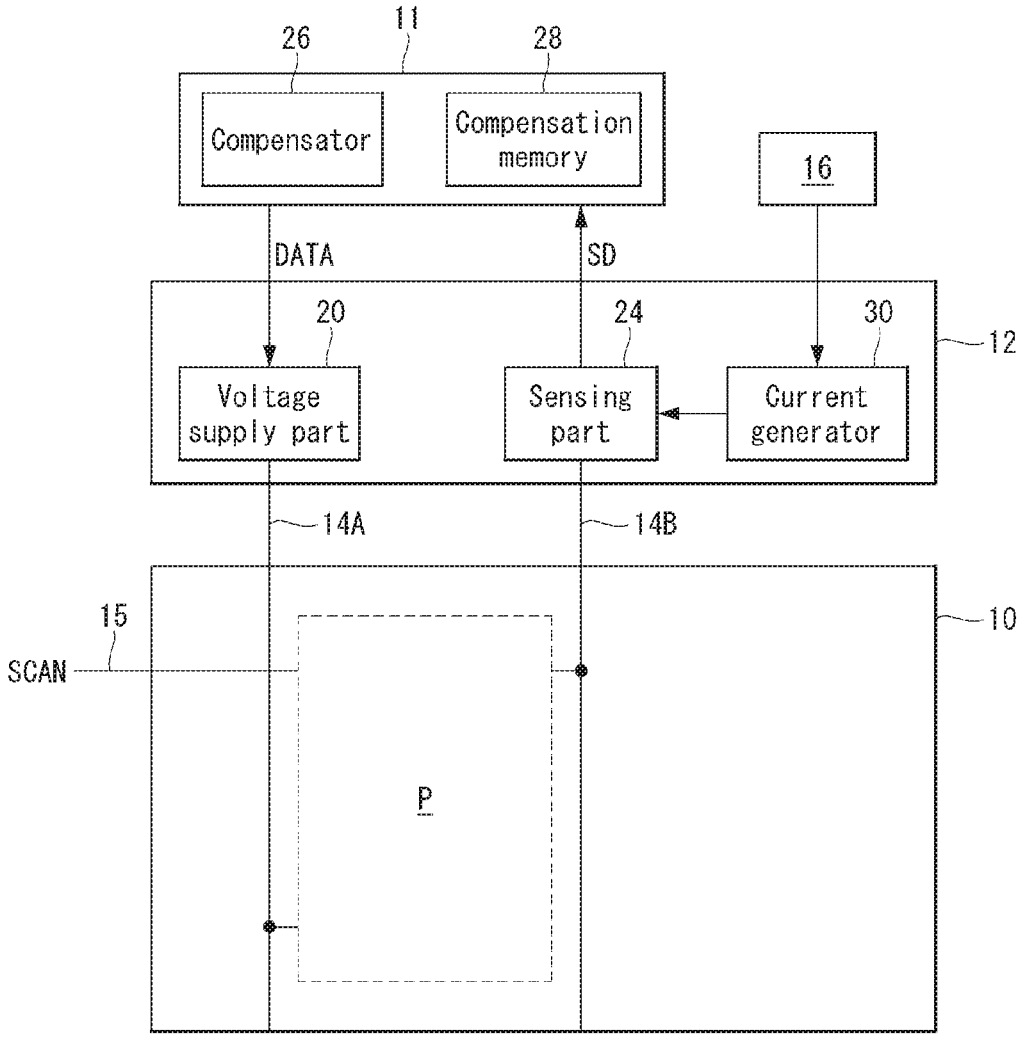
FIG. 2 is a view schematically showing a configuration of a timing controller and a data driver IC according to the exemplary embodiment of the present invention.

FIG. 2 is a view schematically showing a configuration of the timing controller 11 and the data driver IC 12 according to the exemplary embodiment of the present invention.

Referring to FIG. 2, the timing controller 11 comprises a compensation memory 28 storing sensing data SD for data compensation and a compensator 26 for correcting video data to be written on the pixels P.

The timing controller 11 can control a calibration mode for calibration operation, a sensing mode for sensing operation, and a display mode for display operation in a set control sequence. The timing controller 11 acquires first characteristic data representing the driving characteristics of pixels in the sensing mode and acquires second characteristic data representing the output characteristics of the sensing part 24 in the calibration mode, and stores the first and second characteristic data in the compensation memory 28. In the calibration mode, the timing controller 11 can receive an N number of characteristic data from the sensing part 24, set the calculated average value as second characteristic data, and store it in the compensation memory 28, where N is a natural number.

The compensator 26 corrects input video data to be written to the pixels P and outputs the corrected video data to the data driver IC 12, based on the first characteristic data acquired through the sensing mode and the second characteristic data acquired through the calibration mode.

The timing controller 11 can generate timing control signals differently for the display operation, sensing operation, and calibration operation, but not limited thereto. A sensing operation, controlled by the timing controller 11, can be performed during a vertical blanking interval in a display operation, during a power-on sequence before the start of the display operation or during a power-off sequence after the end of the display operation. However, the sensing operation is not limited to this, but can be performed during a vertical active period in the display operation. Meanwhile, a calibration operation can be performed during a vertical blanking interval in a display operation, during a power-on sequence before the start of the display operation or during a power-off sequence after the end of the display operation. However, the calibration period is not limited to this. The vertical blanking interval is the time during which no input video data is written, between each vertical active period during which 1 frame of input video data is written. The power-on sequence is a transition period from turning on the driving power until displaying an input image. The power-off sequence is a transition period from the end of display of an input image until turning off the driving power.

The timing controller 11 can control the overall sensing operation in accordance with a predetermined sensing process. For instance, a sensing operation can be performed when only the screen of the display device is off—for example, in a standby mode, sleep mode, low-power mode, etc.—while the system power is being applied, but the sensing operation is not limited thereto.

The timing controller 11 can control the overall calibration operation in accordance with a predetermined calibration process.

The data driver IC 12 comprises a voltage supply part 20, a sensing part 24, and a current generator 30.

The voltage supply part 20 comprises a digital-to-analog converter (DAC) for converting a digital signal to an analog signal to generate a data voltage for display or a data voltage for sensing. In display operation, the voltage supply part 20 converts digital video data DATA into the form of voltage signal based on gamma reference voltage, in response to a data timing control signal DDC provided by the timing controller 11. The voltage supply part 20 supplies the video data converted in the form of voltage signal to data lines 14A. In the display operation, the data voltage for display supplied to the data lines 14A are applied to the pixels P in synchronization with the turn-on timing of a scan signal SCAN for display.

In a sensing operation, the voltage supply part 20 generates a preset data voltage for sensing and supplies it to the data lines 14A. In the sensing operation, the data voltage for sensing supplied to the data lines 14A is applied to the pixels P in synchronization with the turn-on timing of a scan signal SCAN for sensing. The gate-source voltages of the driving TFTs included in the pixels P are programmed by the data voltage for sensing, and the drive current flowing through the driving TFTs is determined by the gate-source voltages of the driving TFTs.

The sensing part 24 samples a signal for sensing, and converts the sampled signal by an analog-to-digital converter (hereinafter, "ADC") and outputs it to the timing controller 11. The sensing part 24 operates in the sensing mode for sensing the driving characteristics of the pixels P to output first characteristic data, and operates in the calibration mode for sensing the output characteristics of the ADC included in the sensing part 24 to output second characteristic data.

In the sensing mode, the sensing part 24 samples a signal outputted from the pixels P in response to a data voltage for sensing through sensing lines 14B to which the pixels P are connected, and outputs the sampled signal as first characteristic data through the ADC.

In the calibration mode, the sensing part 24 samples a calibration current for sensing the output characteristics of the ADC, and outputs the sampled calibration current as second characteristic data through the ADC.

In the calibration mode, the current generator 30 generates a calibration current and applies it to the sensing part 24. The current generator 30 receives an electrical current from the current source 15 external to the data driver IC 12 and generates calibration current. The source current applied from the current source 16 has a higher value than the calibration current. As such, the current generator 30 generates N calibration currents by dividing the source current into N parts, and sequentially applies the generated calibration currents to the sensing part 24.

Figure 3:
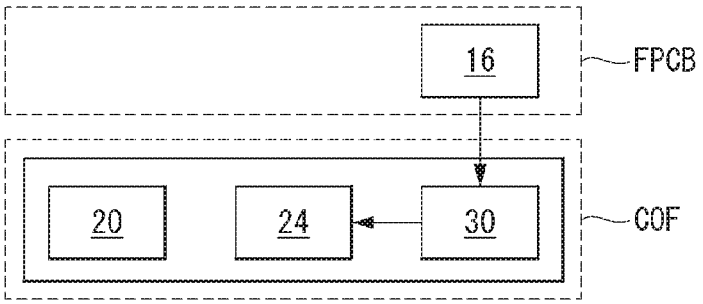
FIG. 3 is a view for explaining an example of implementation of a current source and the data driver IC of FIG. 2.

FIG. 3 is a view for explaining an example of implementation of the current source 16 and the data driver IC 12 of FIG. 2.

Referring to FIG. 3, the data driver IC 12 of the display device according to the exemplary embodiment of the present invention can be implemented as chip-on-film (COF) type, and the current source 16 for supplying an electrical current can be mounted on a flexible printed circuit board (FPCB) and supply an electrical current to the data driver IC 12.

The current source 16 mounted on the FPCB supplies relatively large current to the data driver IC 12. A current generator 30 is formed inside the data driver IC 12 and generates calibration currents, which are 1/N the amount of source current, by dividing an external input source current into N parts.

On the other hand, conventionally, it is necessary to generate and apply a calibration current from outside the data driver IC because no calibration current is generated in the data driver IC. Thus, the FPCB requires a low-current generating circuit, along with the current source 16, in order to reduce the electrical current outputted from the current source 16 to the amount of calibration current. The low-current generating circuit formed in the FPCB is configured by connecting a plurality of resistors, which leads to problems like an increase in the area of the FPCB and an increase in current errors and noise. Another problem is that sensing time increases in proportion to the number of channels because one current source is required to compensate for variation in each channel.

In this regard, in the embodiment(s) of the present invention, the current generator 30 is formed inside the data driver IC 12 implemented as chip-on-film (COF) type, as shown in FIG. 3. Thus, the current generator 30 inside the data driver IC 12 can generate a required amount of calibration current even when the amount of current supplied from the current source 16 is larger than the calibration current. With this configuration, the present invention can bring about a definite decrease in the layout area of the FPCB by eliminating the conventional circuit configuration for low-current generation required on the FPCB, thereby achieving production cost savings and reducing noise and current errors.

Although the above description has been given of one sensing part 24 included in the data driver IC 12 that supplies calibration current, a plurality of sensing parts 24 can be included inside the data driver IC 12 and configured such that each sensing part has a current generator. Moreover, although the above description has been given of one data driver IC 12 connected to one timing controller 11, the timing controller 11 can have two or more data driver ICs 12 and receive first characteristic data and second characteristic data as feedback from each data drive IC and correct input video data to be written to the pixels.

Figure 4:
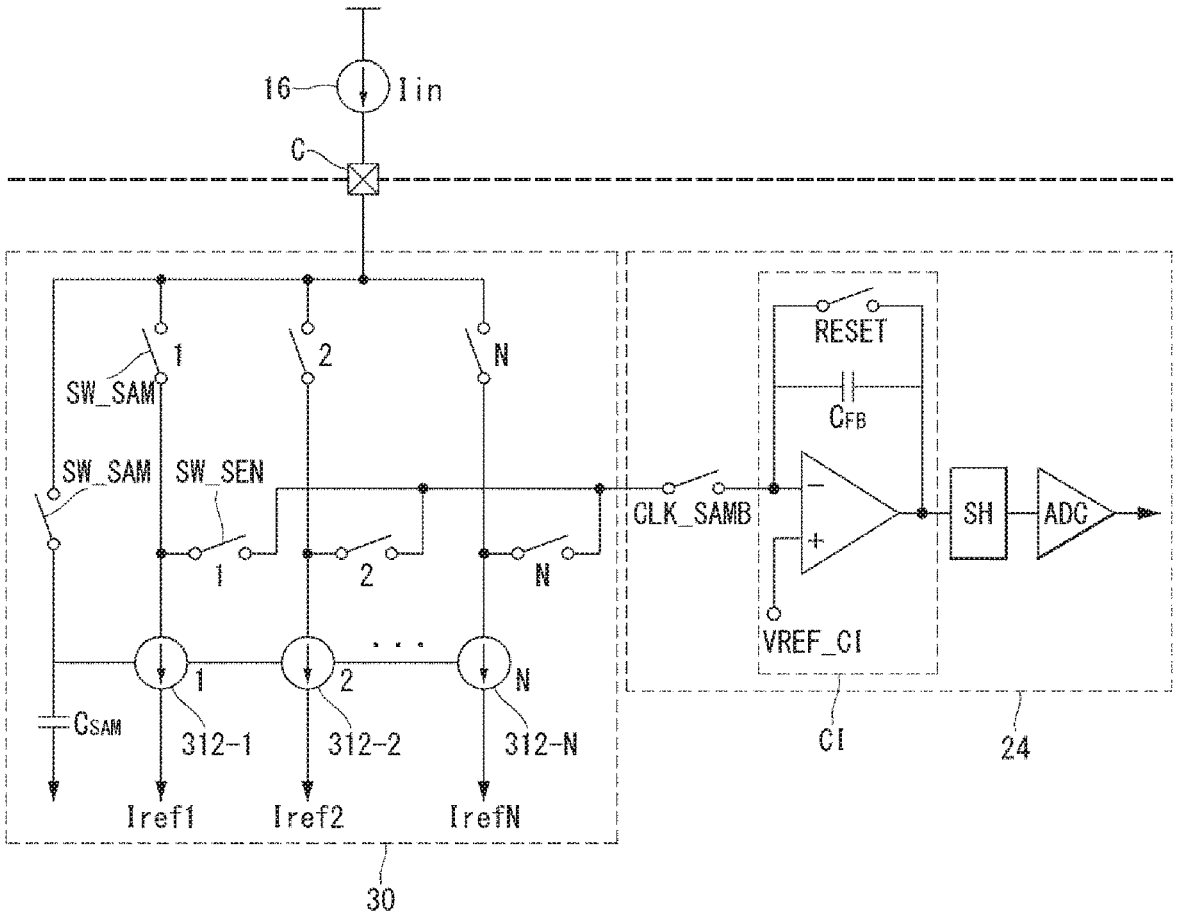
FIG. 4 is a view showing a configuration of a current generator and a sensing part of the display device according to the exemplary embodiment of the present invention.

FIG. 4 is a view showing a configuration of the current generator 30 and the sensing part 24 of the display device according to the exemplary embodiment of the present invention.

Referring to FIG. 4, the current source 16 external to the data driver IC 12 supplies an electrical current to a power input terminal C of the data driver IC 12.

The current generator 30 comprises N current distributors 312-1, 312-2, . . . , 312-N that store a source current Iin inputted through the power input terminal C as N calibration currents Iref1, Iref2, . . . , IrefN, N sampling switches SW_SAM1, 2, . . . , N) that control the supply of the source current Iin inputted to the current distributors 312-1, 312-2, . . . , 312-N, and N sensing switches SW_SEN1, 2, . . . , N that control the calibration currents Iref1, Iref2, . . . , IrefN to output them to the sensing part 24. Here, N is a natural number, e.g., an integer.

The current distributors 312-1, 312-2, . . . , 312-N, respectively connected to N power supply lines branching from a line connected to the power input terminal C, are connected in parallel. A sampling capacitor CSAM is connected to the first parallel-connected stage and charges itself with the same amount of current as the current inputted to each current distributor 312-1, 312-2, . . . , 312-N. The sampling capacitor CSAM can function to maintain the voltage of each current distributor 312-1, 312-2, . . . , 312-N after the supply of source current is discontinued.

The current distributors 312-1, 312-2, . . . , 312-N all have the same electrical characteristics. Thus, equal parts of the source current Iin inputted to the power input terminal C are stored in the N current distributors 312-1, 312-2, . . . , 312-N. As such, one current distributor 312-1 can store a calibration current Iref1 which is 1/N (Iin/N) the amount of source current.

Further, N sampling switches SW_In 1, 2, . . . , N are interposed between the power input terminal C and the current distributors 312-1, 312-2, . . . , 312-N to control the input of source current Iin. The N sampling switches SW_In 1, 2, . . . , N are turned on by a sampling clock CLK_SAM and connect the power input terminal C and the current distributors 312-1, 312-2, . . . , 312-N. As such, the calibration currents Iref1, Iref2, . . . , IrefN are sampled onto the current distributors 312-1, 312-2, . . . , 312-N. The N sampling switches SW_In 1, 2, . . . , N are turned off when the sampling clock CLK_SAM is inverted, which discontinues the supply of source current.

Furthermore, N sensing switches SW_SN1, 2, . . . , N are interposed between the current distributors 312-1, 312-2, . . . , 312-N and an input terminal of the sensing part 24. When one of the N sensing switches SW_SN1, 2, . . . , N is selectively turned on, the corresponding current distributor and an input line of the sensing part 24 are connected. As such, the sensing part 24 is able to sense the calibration current Iref stored in each current distributor 312-1, 312-2, . . . , 312-N.

A switch can be connected to a line connecting the sensing part 24 and the current generator 30 and turned on by an inverted signal CLK_SAMB of the sampling clock CLK_SAM. That is, when the N sampling switches SW_In 1, 2, . . . , N are turned on by the sampling clock CLK_SAM, the switch for the line connecting the sensing part 24 and the current generator 30 is turned off to disconnect the sensing part 24 and the current generator 30 from each other. Afterwards, when the N sampling switches SW_In 1, 2, . . . , N are turned off, the switch for the line connecting the sensing part 24 and the current generator 30 is turned on to connect the sensing part 24 and the current sensing part 30.

In the sensing mode, the sensing part 24 can sample a signal outputted from the pixels in response to a data voltage for sensing and output first characteristic data to the ADC, and, in the calibration mode, can sample a calibration current and output second characteristic data to the ADC.

The sensing part 24 can comprise a current integrator CI, a sample and hold part SH for sampling the output of the current integrator CI, and an ADC for converting the sampled output to digital data.

The current integrator CI can comprise a charge AMP (amplifier) having a non-inverting input terminal (+) connected to a reference voltage VREF_CI, an inverting input terminal (−) for receiving a sensing current, and an output terminal. In the sensing mode, the inverting input terminal (−) of the current integrator CI receives a current signal outputted from the pixels in response to a data voltage for sensing, and, in the calibration mode, receives a calibration current Iref from the current generator 30. The current integrator CI can comprise a reset switch RESET and a feedback capacitor CFB which are connected in parallel between the inverting input terminal and output terminal of the charge AMP.

The sample and hold part SH samples the output of the current integrator CI and the ADC converts the sampled output to digital data and outputs it.

Figure 5:
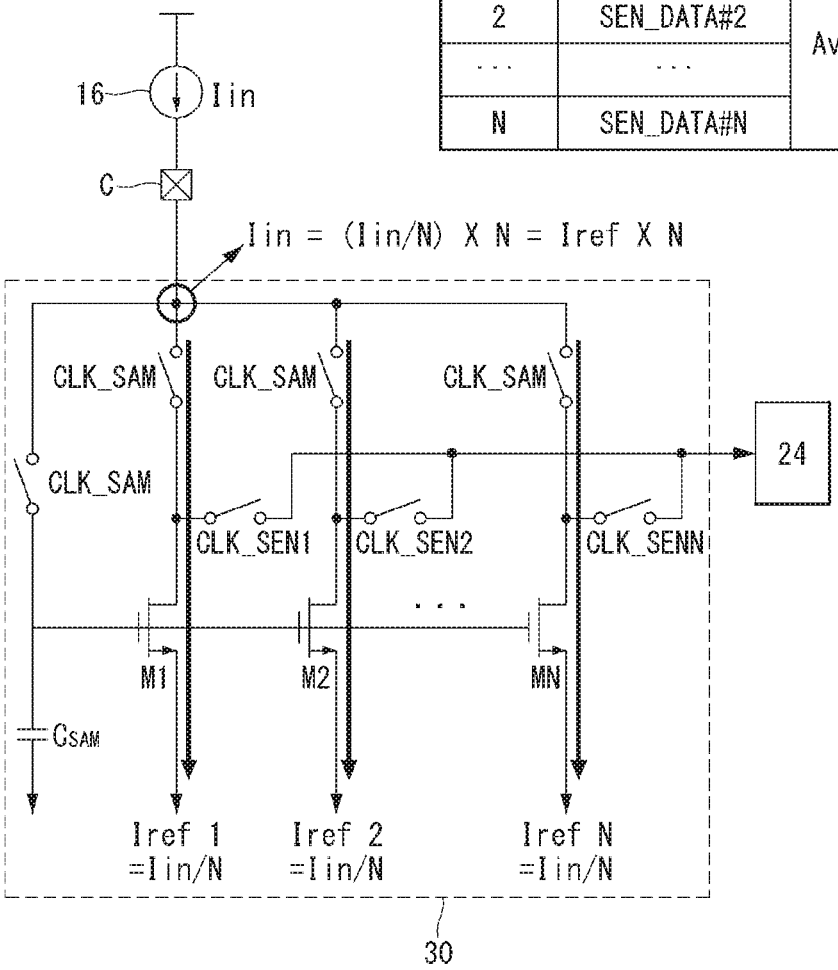
FIG. 5 is a view showing a circuit configuration of the current generator according to the exemplary embodiment of the present invention.
Figure 6:
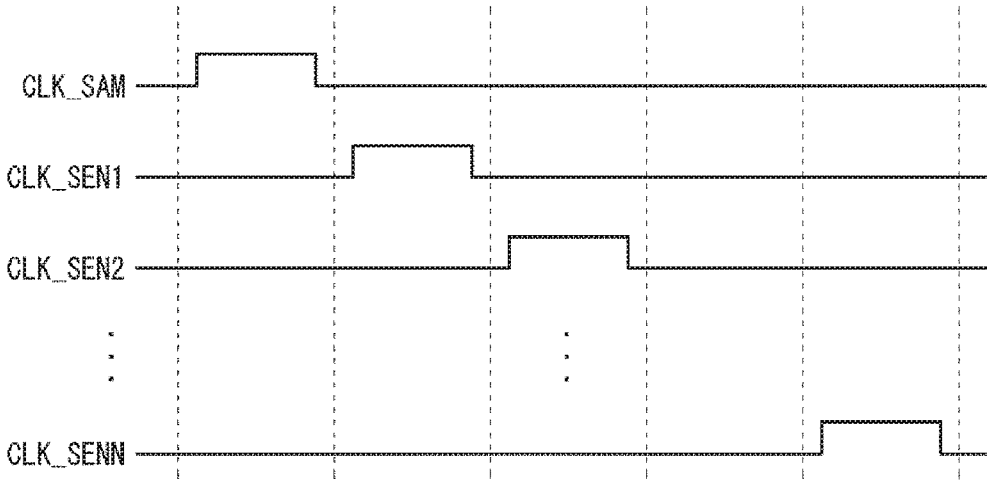
FIG. 6 is a view showing an example of control waveforms of the current generator according to the exemplary embodiment of the present invention.

FIG. 5 is a view showing a circuit configuration of the current generator 30 according to the exemplary embodiment of the present invention. FIG. 6 is a view showing an example of control waveforms of the current generator according to the exemplary embodiment of the present invention.

The current generator 30 of FIG. 5 is an illustration of an embodiment in which N current distributors 312-1, 312-2, . . . , 312-N storing calibrations currents Iref1, Iref2, . . . , IrefN are implemented using N-type MOSFETs (metal oxide semiconductor field effector transistors).

The current generator 30 comprises N current distributors M1, M2, . . . , MN that store a source current Iin externally inputted through the power input terminal C as N calibration currents Iref1, Iref2, . . . , IrefN, N sampling switches SW_SAM1, 2, . . . , N that control the supply of the source current Iin inputted to the current distributors M1, M2, . . . , MN, and N sensing switches SW_SEN1, 2, . . . , N that control the calibration currents Iref1, Iref2, . . . , IrefN to output them to the sensing part 24.

The current distributors M1, M2, . . . , MN, respectively connected to N power supply lines branching from a line connected to the power input terminal C, are connected in parallel. The N-type MOSFETs included in the respective current distributors M1, M2, . . . , MN all have the same channel size. Thus, equal parts of the source current Iin inputted to the power input terminal C are stored in the N current distributors M1, M2, . . . , MN. This can be expressed by the following Equation 1:

$$Iin=(Iin/N)\times N=Iref\times N \quad \text{[Equation 1]}$$

Iin=source current, Iref=calibration current

The first current distributor M1 can store a calibration current Iref1 which is 1/N (Iin/N) the amount of source current, and the second current distributor M2 can store a calibration current Iref2 which is 1/N (Iin/N) the amount of source current. A sampling capacitor CSAM is connected to the first parallel-connected stage and charges itself with the same amount of current as the current inputted to each current distributor M1, M2, . . . , MN.

First electrodes of the current distributors M1, M2, . . . , MN are connected to the sampling switches SW_SAM1, 2, . . . , N and the sensing switches SW_SEN1, 2, . . . , N, and gate terminals thereof are connected to the sampling capacitor CSAM. Thus, when the sampling switches SW_SAM1, 2, . . . , N are turned on, the first electrodes of the current distributors M1, M2, . . . , MN are connected to the power input terminal C, and when the sensing switches SW_SEN1, 2, . . . , N are turned on, the first electrodes are connected to the sensing part 24.

The on/off operation of the N sampling switches SW_SAM1, 2, . . . , N can be controlled by the sampling clock CLK_SAM of FIG. 6. When the N sampling switches SW_SAM1, 2, . . . , N are turned on, the power input terminal C and the current distributors M1, M2, . . . , MN are connected. As such, the calibration currents Iref1, Iref2, . . . , IrefN are sampled onto the respective current distributors M1, M2, . . . , MN. When the sampling clock CLK_SAM is inverted, the N sampling switches SW_SAM1, 2, . . . , N are turned off to discontinue the supply of source current Iin. When the N sampling switches SW_SAM1, 2, . . . , N are turned off, the gate terminals of the current distributors M1, M2, . . . , MN are connected to the sampling capacitor CSAM, thus maintaining the gate-source voltages by the electrical power stored in the sampling capacitor CSAM.

When one of the N sensing switches SW_SEM1, 2, . . . , N is selectively turned on, the corresponding current distributor and an input line of the sensing part 24 are connected. The N sensing switches SW_SEN1, 2, . . . , N are turned on when the sensing clock CLK_SEN of FIG. 6 is high, and turned off when it is low. The N sensing switches SW_SEN1, 2, . . . , N can be sequentially turned on in such a way that the first sensing switch SW_SEN1 is turned on upon receiving a first sensing clock CLK_SEN1, and then, after the first sensing switch SW_SEN1 is turned off, the second sensing switch SW_SEN2 is turned on upon receiving a second sensing clock CLK_SEN2. The N sensing switches SW_SEN1, 2, . . . , N are sequentially connected to the input line of the sensing part 24.

As such, the sensing part 24 sequentially senses the calibration currents Iref1, Iref2, . . . , IrefN stored in the respective current distributors M1, M2, . . . , MN and sequentially outputs sensing values SEN_DATA #1, SEN_DATA #2, SEN_DATA # N.

The timing controller 11 can receive the N sensing values SEN_DATA #1, SEN_DATA #2, SEN_DATA # N from the sensing part 24, set the calculated average value as second characteristic data, and store it in the compensation memory 28. This can be expressed by the following equation:

$$\text{Second characteristic data} = \frac{(Iref1 + Iref2 + \ldots IrefN)}{N} \quad \text{[Equation 2]}$$

When the respective calibration currents Iref1, Iref2, . . . , IrefN are sensed in an actual circuit, current error components and noise can be included in the sensing values SEN_DATA #1, SEN_DATA #2, SEN_DATA # N. However, in the present invention, the average of these errors can be taken so that noise or the like can be cancelled out when adding the errors and therefore reduced to 1/N. Hence, the reliability of the final calculated second characteristic data can be improved.

Figure 7A:
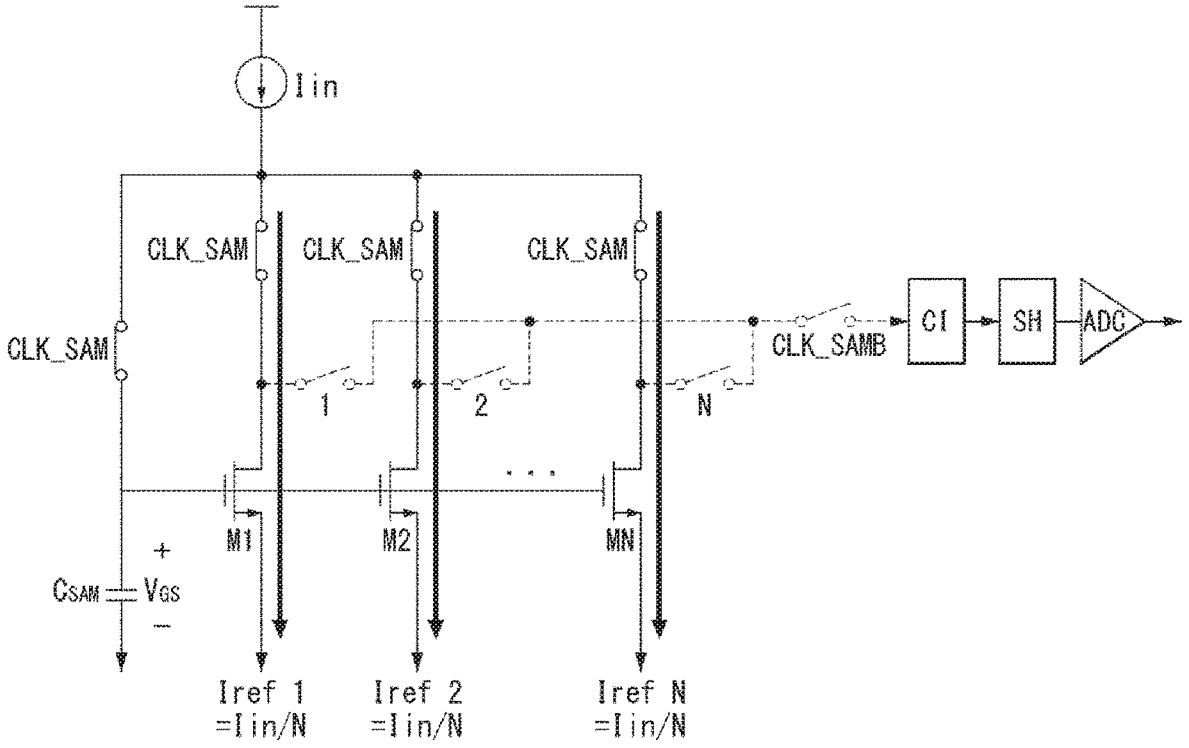
FIGS. 7*a* to 7*c* are views showing a circuit operation of the current generator of FIG. 5.
Figure 7B:
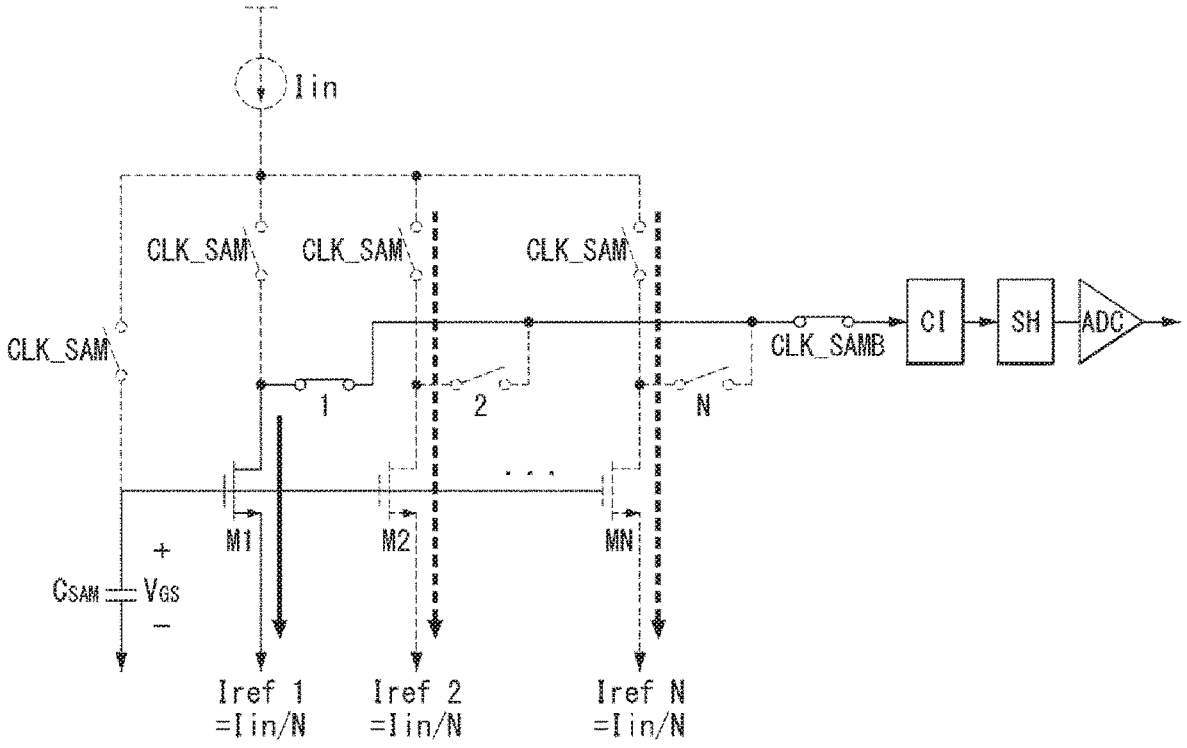
Figure 7C:
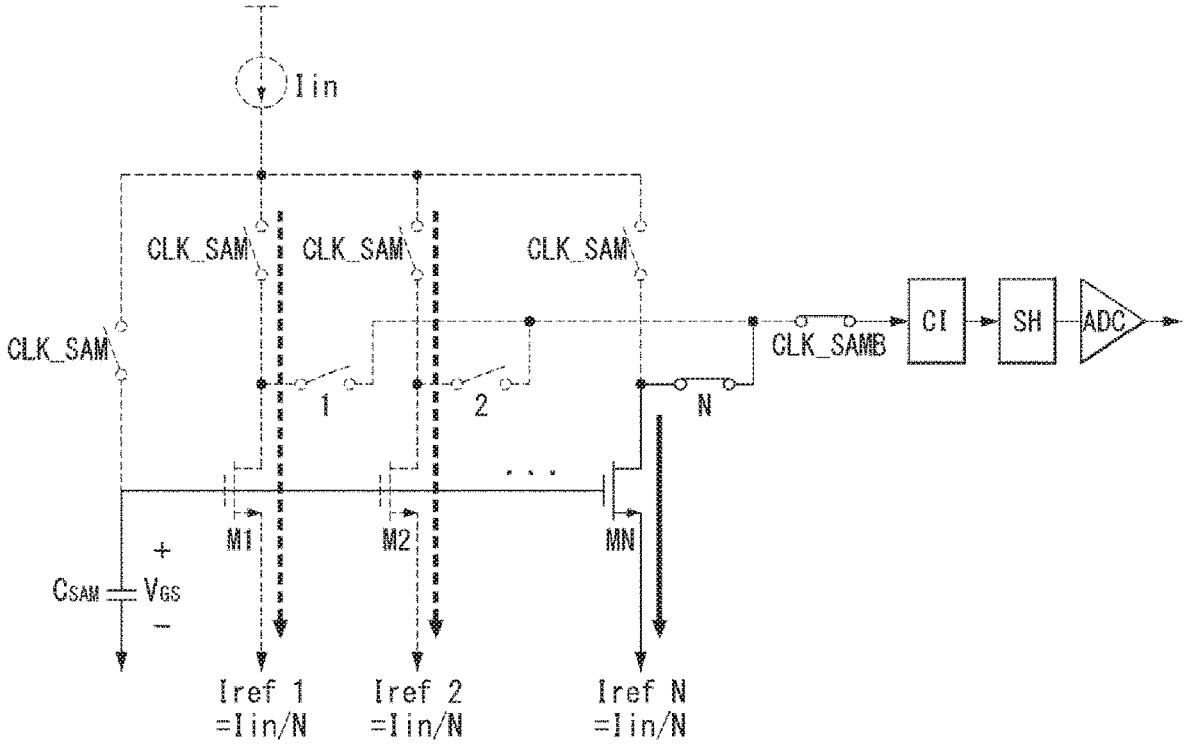

FIGS. 7*a* to 7*c* are views showing a circuit operation of the current generator of FIG. 5. FIG. 7*a* is a view showing an operation of sampling the calibration currents Iref1, Iref2, . . . , IrefN onto the current distributors M1, M2, . . . MN, FIG. 7*b* is a view showing an operation of sensing the calibration current Iref1 of the first current distributor M1, and FIG. 7*c* is a view showing an operation of sensing the calibration current IrefN of the Nth current distributor MN.

Referring to FIG. 7*a*, in the calibration current sampling step, all of the N sampling switches SW_SAM1, 2, . . . , N are turned on upon receiving a sampling clock CLK_SAM, and the switch for the line connecting the sensing part 24 and the current generator 30 is turned off to disconnect the sensing part 24 and the current generator 30 from each other.

When the N sampling switches SW_SAM1, 2, . . . , N are turned on, the power input terminal C and the current distributors M1, M2, . . . , MN are connected to distribute the source current Iin inputted to the input terminal C to the current distributors M1, M2, . . . , MN. The current distributors M1, M2, . . . , MN, respectively connected to N power supply lines branching from a line connected to the power input terminal C, are connected in parallel. The N-type MOSFETs included in the respective current distributors M1, M2, . . . , MN all have the same channel size. Thus, equal parts of the source current Iin inputted to the power input terminal C are stored in the N current distributors M1, M2, . . . , MN. As such, the calibration currents Iref1, Iref2, . . . , IrefN, which are Iin/N the amount of source current, are sampled onto the current distributors M1, M2, . . . , MN. The source current Iin is also distributed to the sampling capacitor CSAM, and the gate-source voltages of the current distributors are stored in the sampling capacitor CSAM.

Referring to FIG. 7*b*, in the calibration current sensing step, all of the N sampling switches SW_SAM1, 2, . . . , N are turned off, and the switch for the line connecting the sensing part 24 and the current generator 30 is turned on to connect the sensing part 24 and the current generator 30. When the sampling switches SW_SAM1, 2, . . . , N are turned off, the gate terminals of the current distributors M1, M2, . . . , MN are connected to the sampling capacitor CSAM, thereby maintaining the gate-source voltages by the electrical power stored in the sampling capacitor CSAM.

When the first sensing switch SW_SEN1, among the N sensing switches SW_SEN1, 2, . . . , N, is turned on upon receiving a first sensing clock CLK_SEN1, the first current distributor M1 is connected to the input line of the sensing part 24. As such, the sensing part 24 senses the calibration current Iref1 stored in the first current distributor M1 and outputs a sensing value SEN_DATA #1.

Referring to FIG. 7*c*, in the calibration current sensing step, all of the N sampling switches SW_SAM1, 2, . . . , N are turned off, and the switch for the line connecting the sensing part 24 and the current generator 30 is turned on to connect the sensing part 24 and the current generator 30. The sampling switches SW_SAM1, 2, . . . , N are sequentially turned on and then off, and lastly the Nth current distributor MN is connected to the input line of the sensing part 24. As such, the sensing part 24 senses the calibration current IrefN stored in the Nth current distributor MN and outputs a sensing value SEN_DATA # N.

The N sensing values SEN_DAT #1, SEN_DATA #2, SEN_DATA # N outputted from the sensing part 24 are delivered to the timing controller 11. After receiving the N sensing values SEN_DAT #1, SEN_DATA #2, SEN_DATA # N, the timing controller 11 sets the calculated average value as second characteristic data, and store it in the compensation memory 28.

Figure 8:
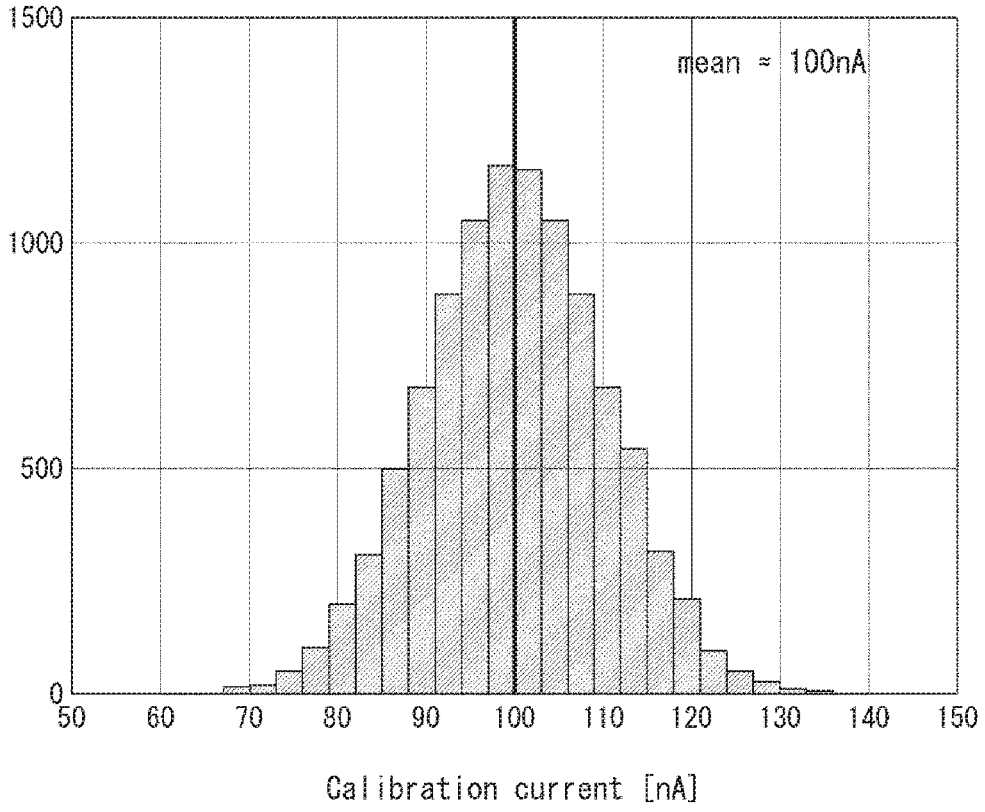
FIG. 8 is a graph of simulation results according to an example of the present invention.

FIG. 8 is a graph of simulation results obtained by applying a source current of 1 uA to a current generator 30 having ten current distributors and sensing calibration currents Iref1, Iref2, . . . , IrefN of 100 nA each.

After sensing a current of 100 nA+e (e is an error component such as noise, current error components, etc.) sampled onto each current distributor and taking the average of the data, it was found out that the calculated average value was 100 nA, as in the histogram of FIG. 8.

That is, it was found out through simulation that, by implementing the current generator 30 having ten current distributors in an actual circuit according to the exemplary embodiment of the present invention, calibration currents of 100 nA each, which are exactly 1/10 the source current of 1 uA, can be produced.

As explained above, the embodiment(s) of the present invention can reduce current errors and noise and decrease sensing time by forming a current generator inside the data driver IC and supplying calibration currents for sensing the output characteristics of the ADC, rather than by the conventional approach of supplying an electrical current from outside the data driver IC.

Furthermore, while the conventional approach has the problems like increased PCB area and increased production costs because a large-sized circuit including a plurality of resistors is required in order to generate low calibration currents outside the data driver IC, the embodiment(s) of the present invention allow for a decrease in the layout area of the PCB required for low calibration current generation and a reduction in production costs by generating calibration currents inside the data driver IC.

Although preferred embodiments of the present invention are described above with reference to the accompanying drawings, it is understood that those skilled in the art can embody the technical configuration in other specific forms without changing the technical spirits and essential features of the present invention. Therefore, it should be understood that the embodiments described above are exemplary and not restrictive in all aspects, and the scope of the present invention is defined by the appended claims rather than the above specific descriptions. It should be interpreted that all the changed and modified forms derived from the meaning, scope and equivalent concepts of the claims are included in the scope of the present invention.

What is claimed is:

1. A data driver integrated circuit (IC) comprising:

an analog-to-digital converter;

a sensing part that, in a sensing mode, samples a signal outputted from pixels in response to a data voltage for sensing, and, in a calibration mode, samples a calibration current and outputs the same to the analog-to-digital converter; and a current generator that generates N calibration currents by dividing an external input source current into N parts, where N is a natural number.

2. The data driver IC of claim 1, wherein the current generator comprises:

N current distributors that store the source current as N calibration currents;

N sampling switches that control the supply of the source current inputted to the N current distributors; and N sensing switches that control the calibration currents to output the same to the sensing part.

3. The data driver IC of claim 2, wherein, in the current generator, when all of the N sampling switches are turned on and all of the N sensing switches are turned off, the source current is stored in the N current distributors, and, when all of the N sampling switches are turned off and the N sensing switches are selectively turned on, the calibration currents are outputted to the sensing part.

4. The data driver IC of claim 2, wherein the current distributors comprise N transistors of a same channel size.

5. The data driver IC of claim 4, wherein the current distributors comprise a sampling capacitor that stores the gate-source voltages of the transistors.

6. The data driver IC of claim 4, wherein the transistors included in the current generator are N-type transistors.

7. The data driver IC of claim 1, wherein the sensing part comprises:

an amplifier having a non-inverting input terminal connected to a reference voltage, an inverting input terminal for receiving the calibration currents, and an output terminal;

a reset switch and a feedback capacitor connected in parallel between the inverting input terminal and the output terminal; and a sample and hold part that samples the output of the amplifier and outputs the same to the analog-to-digital converter.

8. The data driver IC of claim 1, further comprising a voltage supply part that supplies a video data voltage to the pixels in a display mode and supplies a data voltage for sensing to the pixels in the sensing mode.

9. A display device comprising:

a display panel with a plurality of pixels; and the data driver IC of claim 1 connected to the display panel.

10. The display device of claim 9, further comprising a timing controller that corrects input video data to be written to the pixels, based on first characteristic data produced by sampling a signal outputted from the pixels in a sensing mode and second characteristic data produced by sampling a calibration current in a calibration mode.

11. The display device of claim 10, wherein the timing controller corrects the input video data by receiving an N number of second characteristic data corresponding to N calibration currents and taking the average of the N number of second characteristic data.

12. A display device comprising:

a display panel with a plurality of pixels connected to sensing lines;

a current source that supplies an electrical current;

a data driver integrated circuit (IC) having a sensing part that, in a sensing mode, samples a signal outputted from the pixels in response to a data voltage for sensing to output first characteristic data to an analog-to-digital converter, and, in a calibration mode, samples a calibration current to output second characteristic data to the analog-to-digital converter; and a timing controller that corrects input video data to be written to the pixels based on the first characteristic data and the second characteristic data, wherein the data driver IC generates N calibration currents by dividing the current supplied from the current source into N parts, where N is a natural number.

13. The display device of claim 12, wherein the data driver IC comprises a current generator comprising:

N current distributors that store the current supplied from the current source as N calibration currents, N sampling switches that control the supply of the source current inputted to the N current distributors, and N sensing switches that control the calibration currents to output the same to the sensing part, and wherein the timing controller corrects the input video data by receiving an N number of second characteristic data corresponding to N calibration currents and taking the average of the N number of second characteristic data.

14. A method of driving a display device, the method comprising:

generating N calibration currents by a current generator inside a data driver integrated circuit (IC) by dividing an external input source current into N parts, where N is a natural number;

sampling the N calibration currents to produce an N number of digital data by a sensing part inside the data driver IC;

receiving the N number of digital data and taking the average thereof by a timing controller;

storing the calculated average value as second characteristic data representing the output characteristics of the analog-to-digital converter of the sensing part; and correcting video data based on the second characteristic data by the timing controller.

15. The method of claim 14, further comprising:

sampling a signal outputted from pixels in response to a data voltage for sensing to produce digital data by the sensing part inside the data driver IC; and storing the digital data produced by sampling a signal outputted from the pixels as first characteristic data representing the driving characteristics of the pixels, wherein the correcting of video data comprises correcting input video data to be written to the pixels based on the first characteristic data and the second characteristic data.

* * * * *